United States Patent [19]

Norman et al.

[11] Patent Number: 4,989,357

[45] Date of Patent: Feb. 5, 1991

[54] MUZZLELOADER SAFETY

[76] Inventors: John W. Norman, 8029 Golden Oak Rd., Oklahoma City, Okla. 73127; Charles W. Rowell, 513 Jean Marie Dr., Norman, Okla. 73069

[21] Appl. No.: 297,991

[22] Filed: Jan. 17, 1989

[51] Int. Cl.[5] ..... F41A 17/74

[52] U.S. Cl. ..... 42/70.08; 42/51

[58] Field of Search ..... 42/51, 69.03, 70.08, 42/66, 70.06

[56] References Cited

U.S. PATENT DOCUMENTS

| | | | |
|---|---|---|---|
| 109,514 | 11/1870 | Hay | 42/70.08 |
| 239,652 | 4/1881 | Fiske . | |
| 565,678 | 8/1896 | Foster . | |
| 1,256,631 | 2/1918 | Zeymer . | |
| 2,225,583 | 12/1940 | Blizard . | |
| 3,577,667 | 5/1971 | Kern . | |
| 3,824,728 | 7/1974 | Kennedy . | |
| 4,208,947 | 6/1980 | Hillberg | 42/70.08 |
| 4,468,877 | 9/1984 | Karvonen . | |

*Primary Examiner*—Charles T. Jordan
*Assistant Examiner*—Richard W. Wendtland
*Attorney, Agent, or Firm*—Dunlap, Codding, Peterson & Lee

[57] ABSTRACT

A safety assembly for use with firing weapons is provided. The safety assembly may be selectively positioned between an on position and a off position. In the on position, the safety assembly prevents the hammer of the firing weapon from pivoting from a firing position to a fired position. In the off position, the safety assembly permits the hammer of the firing weapon to fall from the firing position to the fired position.

11 Claims, 4 Drawing Sheets

MUZZLELOADER SAFETY

FIELD OF THE INVENTION

The present invention relates generally to safety devices for use with firing weapons for preventing the inadvertent discharge thereof.

DESCRIPTION OF THE PREFERRED EMBODIMENTS

An original muzzleloader generally is considered to be a collector's item and is generally utilized solely for display purposes. However, in recent times fully operational replicas of these weapons have been manufactured for both competitive shooting and for hunting purposes. Further, many wildlife and fishery departments tacitly encourage the use of these weapons by providing extended "primitive weapon" hunting seasons for hunters desiring to take game with these weapons.

An original muzzleloader is equipped with an external hammer pivotally secured on the lock of the firing weapon. In most instances, muzzleloader replicas are not provided with a safety mechanism to prevent the inadvertent discharge of the weapon when the hammer is set in a firing position.

The present invention provides an economical and efficient safety mechanism for use in a muzzleloader. The present invention comprises a slidable safety assembly for blocking the fall of the hammer from the firing position to the fired position so that the hammer is prevented from striking the lock and discharging the weapon. Moreover, the present invention is constructed such that installation thereof does not disturb the authentic appearance of the replicated weapon.

Figure 1:
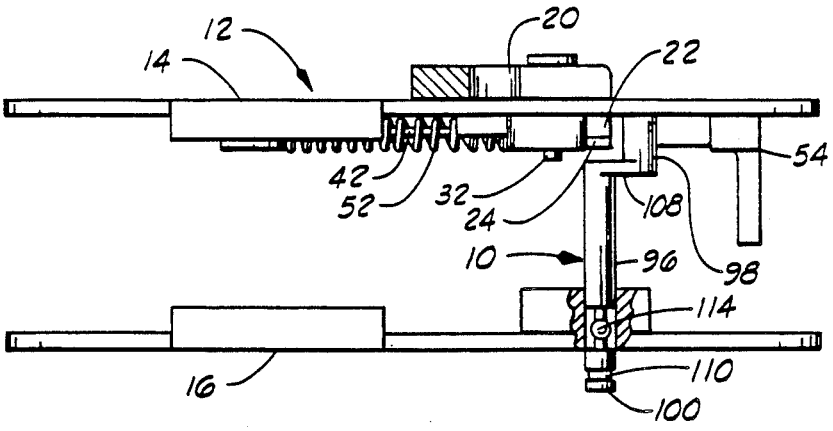
FIG. 1 is a top plan view of a safety assembly constructed in accordance with the present invention. The safety assembly is secured on a lock assembly of a firing weapon.
Figure 2:
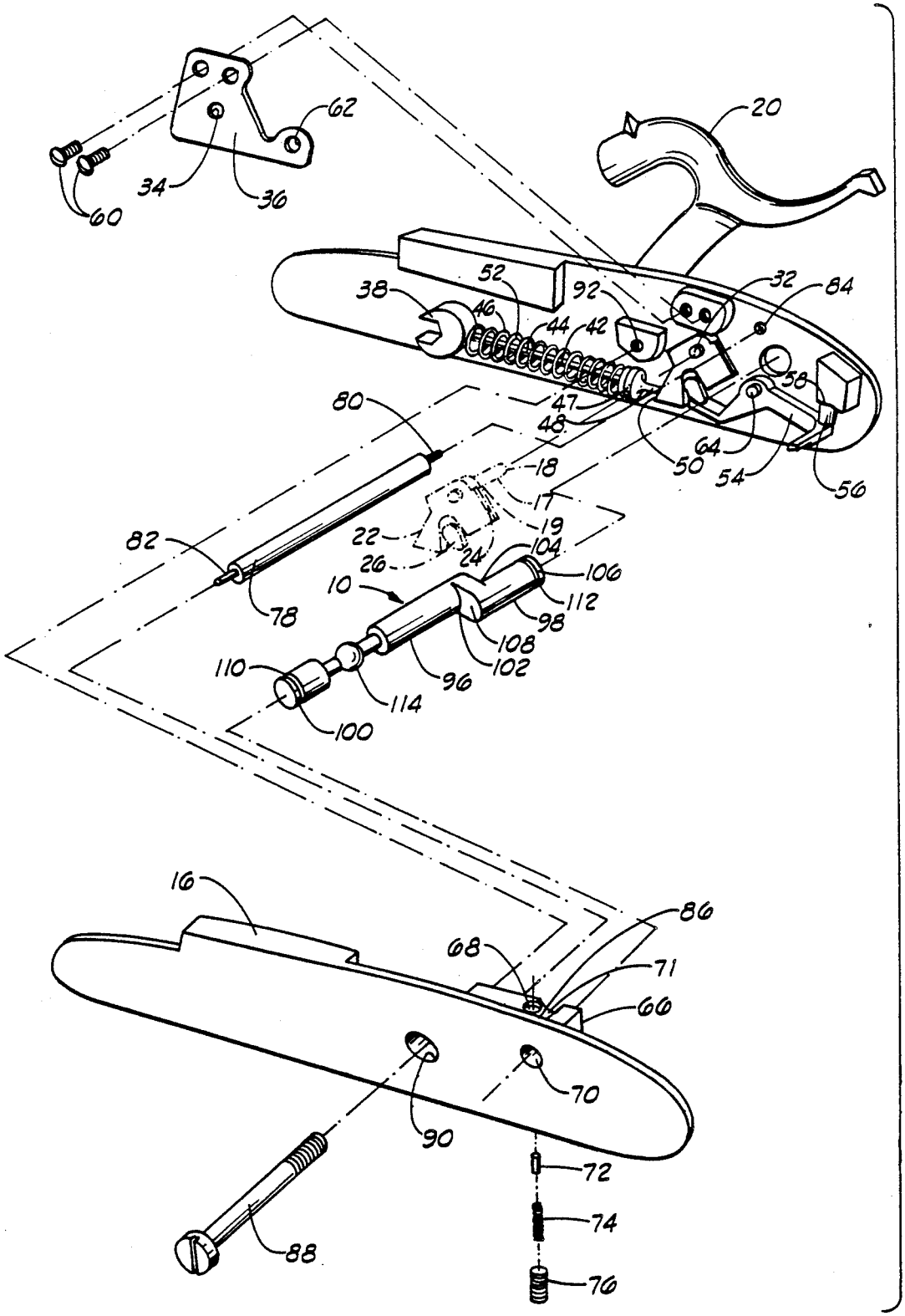
FIG. 2 is an exploded perspective view of the lock assembly shown in FIG. 1.

Shown in FIGS. 1 and 2, and referred to herein by the general reference numeral 10, is a safety assembly constructed in accordance with the present invention. The safety assembly 10 is slidably secured on a lock assembly 12 between a first lock plate 14 and a second lock plate 16. The first lock plate 14 and the components secured thereto, which are described in greater detail below, are similar in design and function to the percussion lock assembly manufactured by Thompson/Center Arms Company, Rochester, N.H. for the Hawken Rifle.

The stock (not shown) of the firing weapon is positioned between the first lock plate 14 and the second lock plate 16. The first and second lock plates, 14 and 16 respectively, are secured on the stock, and portions of the stock are formed to accept the structures attached to the respective lock plates. The lock assembly 12 cooperates with a trigger assembly (not shown) and a barrel assembly (not shown) such that the weapon may be utilized in the conventional manner. The lock assembly 12 and the safety assembly 10 may be used in combination with the trigger assembly and barrel assembly of the type manufactured by Thompson/Center Arms Company for the Hawken Rifle.

As best seen in FIG. 2, the lock assembly 12 includes a shaft 17 rotatably secured within the first lock plate 14. The shaft has a first end 18 and a second end 19. A hammer 20 is secured on the first end 18 of the shaft 17 for movement between a fired position (FIG. 3) and a firing position (FIG. 8).

Figure 3:
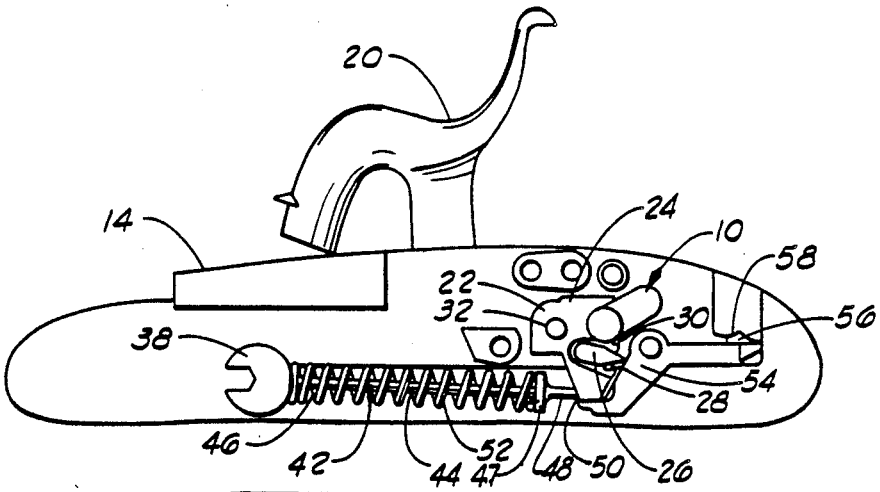
FIG. 3 is an elevational view of the lock assembly shown is FIG. 1 with portions removed illustrating the lock assembly in the fired position.
Figure 4:
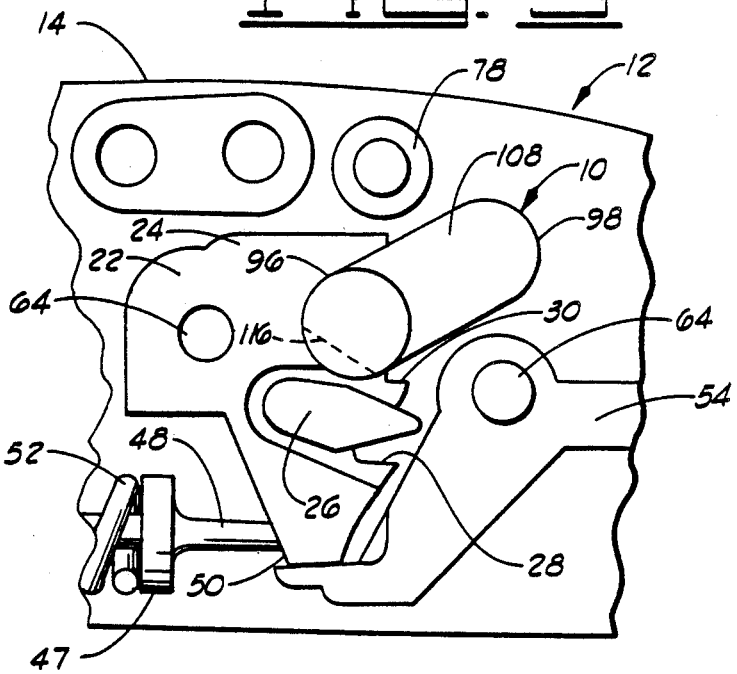
FIG. 4 is an enlarged fragmentary elevational view of the lock assembly shown in FIG. 3.
Figure 8:
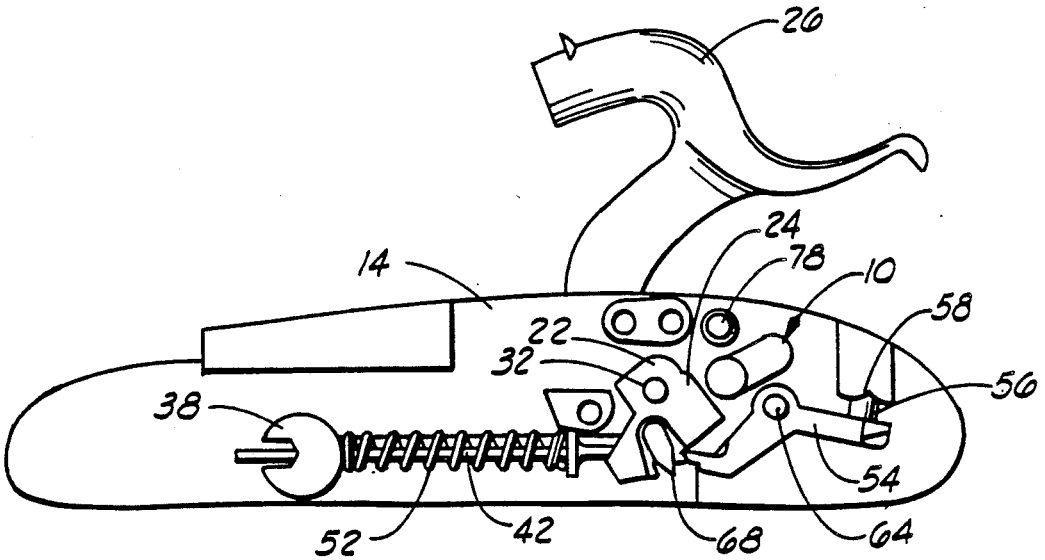
FIG. 8 is an elevational view of the lock assembly in the firing position.

The first lock plate 14 also includes a tumbler 22 secured on the second end 19 of the shaft 17 such that the tumbler 22 pivots when the hammer 20 is moved between the fired (FIG. 3) position and the firing position (FIG. 8). The tumbler 22 is provided with a web 24, a pivoting fly 26, a first slot 28 and a second slot 30. As shown in FIGS. 3 and 4, the tumbler 22 further includes a bearing arm 32 extending therefrom. The bearing arm 32 is journalled to an aperture 34 of a bridle plate 36.

The first lock plate 14 further includes a stop member 38 secured thereto. The stop member 38 has a horizontal aperture (not shown) sized for receiving a portion of a plunger 42. The plunger 42 includes a rod 44 having a first end 46 and a second end 48 and a raised annular shoulder 47, formed integral therewith. The shoulder 47 is positioned between the first end 46 and the second end 48 nearer the second end 48. The first end 46 of the plunger 42 is sized for insertion into the aperture of the stop member 38. The second end 48 is inserted into a slot (not shown) in the tumbler 22 at position 50.

A main spring 52 is inserted around the plunger 42 and is compressed between the stop member 38 and the shoulder 47. In this way, when the second end 48 is inserted into the slot of the tumbler 22 at position 50, the main spring 52 biases the hammer 20 towards the fired position (FIG. 3).

The first lock plate 14 also includes a sear 54 pivotally secured thereto. The sear 54 is biased in a conventional manner by a sear plunger 56 secured on the first lock plate 14 at position 58. In this way, the sear 54 may selectively engage the first slot 28 or the second slot 30 of the tumbler 22. When the sear 54 engages the first slot 28, the hammer 20 is supported in a half cocked position (FIG. 5) and when the sear 54 engages the second slot 30, the hammer is supported in the fully cocked or firing position (FIG. 8).

As shown in FIG. 2, the bridle plate 36 is securable to the first lock plate 14 by a pair of bridle screws 60. The bridle plate 36 also includes an aperture 62 sized for receiving a bearing arm 64 secured on and extending from the sear 54. Thus, when the bridle plate 36 is secured on the first lock plate 14, the tumbler 22 and the sear 54 are pivotally supported between the bridle plate 36 and the first lock plate 14.

As shown in FIG. 2, the second lock plate 16 includes a housing 66 having a vertical through bore 68 intersected by a horizontal through bore 70. The housing 66 also includes a slot 71 for a purpose to be discussed below. The vertical bore 68 is sized for receiving a rider 72, a rider spring 74 and a set screw 76.

The lock assemble 12 further includes a support pin 78, for a purpose to be discussed below, having a first end 80 and a second end 82. The first end 80 is threadedly secured on the first lock plate 14 at position 84. The second end 82 is inserted into a annular recess (not shown) in the second lock plate 16 at position 86. It will now be appreciated that the slot 71 is sized to accommodate the support pin 78 when the support pin 78 is positioned between the first lock plate 14 and the second lock plate 16.

A lock plate screw 88 is inserted through an aperture 90 in the second lock plate 16 and threadedly secured into an aperture 92 in the first lock plate 14. In this way, the lock plate assemble 12 is secured on the stock of the firing weapon.

As most clearly illustrated in FIG. 2, the safety assembly 10 has a first bar portion 96 and a second bar portion 98. The first bar portion 96 has a first end 100 and a second end 102. The second bar portion 98 has a first end 104 and a second end 106. The safety assembly 10 further includes a web 108 integral therewith and positioned between the second end 102 of the first bar portion 96 and the first end 104 of the second bar portion 98 such that the center lines of the first bar portion 96 and the second bar portion 98 are offset. The offset between the first bar portion 96 and the second bar portion 98 is of sufficient distance such that the second bar portion 98 does not block the pivotal movement of the tumbler 22 when the safety assembly 10 is in an off position (FIG. 1).

The offset between the first bar portion 96 and the second bar portion 98 is also of sufficient distance such that the first bar portion 96 is positioned under and aligned with the support pin 78. In this way, when the safety assembly 10 is contacted by the tumbler 22 (FIG. 7), the support pin 78 will prevent the safety assembly 10 from rotating within the lock assembly 12.

The safety assembly 10 further comprises a first annular groove 110 at the first end 100 of the first bar portion 96 and a second annular groove 112 at the second end 106 of the second bar portion 98. In the preferred embodiment, a red pigmented material is applied to the surfaces defining the first annular groove 110, and a white pigmented material is applied to the surfaces defining the second annular groove 112. In this way, when the safety assembly 10 is selectively configured in the off position (FIG. 1), the first end 100 of the first bar portion 96 extends outwardly from the second lock plate 16 exposing the first annular groove 110 and the pigmented material therein. The protruding first annular groove 110 indicates that the hammer 20 is free to pivot from the firing position to the fired position.

Conversely, when the safety assembly 10 is selectively configured in an on position (FIG. 7), the second end 102 of the first bar portion 96 blocks the pivotal movement of the tumbler 22. Blocking the pivotal movement of the tumbler 22 prevents the hammer 20 from pivoting from the firing position to the fired position. Additionally, the second end 106 of the second bar portion 98 extends outwardly from the first lock plate 14 exposing the second annular groove 112 and the pigmented material therein. Therefore, the protruding second annular groove 112 indicates that the safety assembly is positioned such that the hammer 20 is prevented from pivoting from the firing position to the fired position.

As shown in FIG. 2, the bar portion 96 includes a detent 114 formed therein between the first end 100 and the second end 102 thereof. The first bar portion 96 also has a groove 116 (FIG. 7) therein at the second end 102 thereof. The groove 116 sized for cooperation with the web 24 of the tumbler 22 for a purpose to be discussed below.

It will now be appreciated that when the rider 72, the rider spring 74 and the set screw 76 are installed within the vertical bore 68 the rider 72 is upwardly biased therein. In this way, the rider 72 is urged against the detent 114 such that the safety assembly 10 may be selectively retained in either the on position (FIG. 7) or the off position (FIG. 1).

Figure 5:
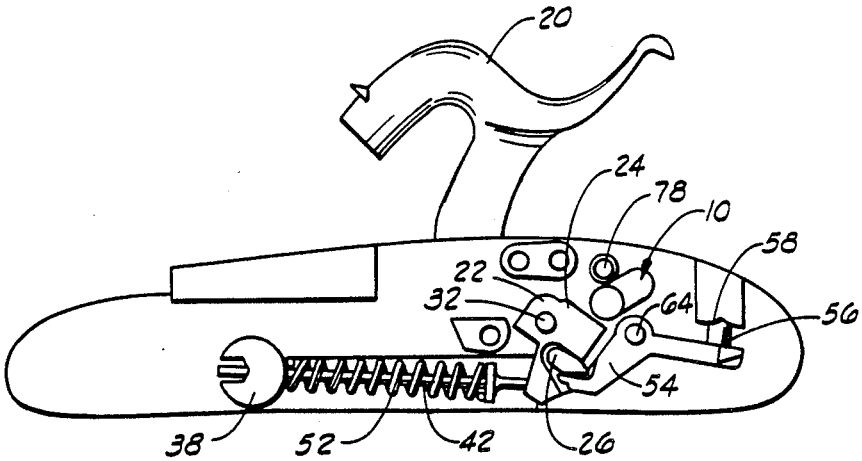
FIG. 5 is an elevational view of the lock assembly in the half cocked position.
Figure 6:
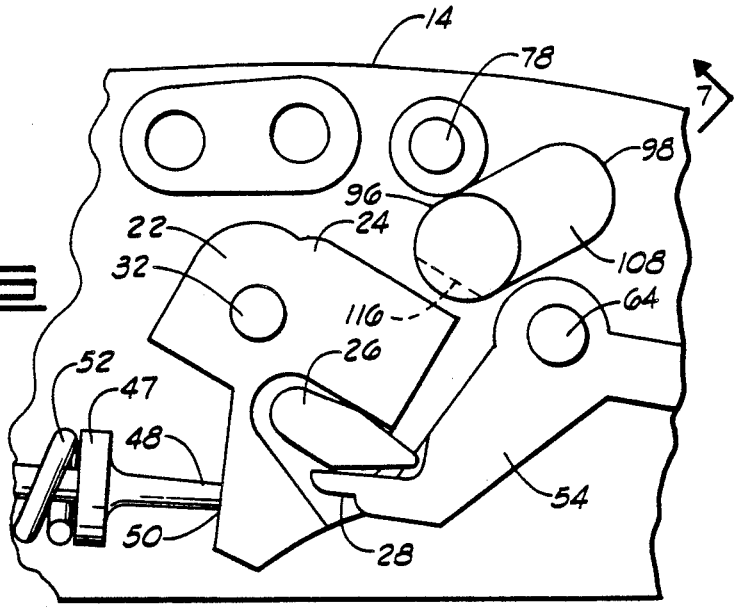
FIG. 6 is an enlarged fragmentary elevational view of the lock assembly shown in FIG. 6.
Figure 7:
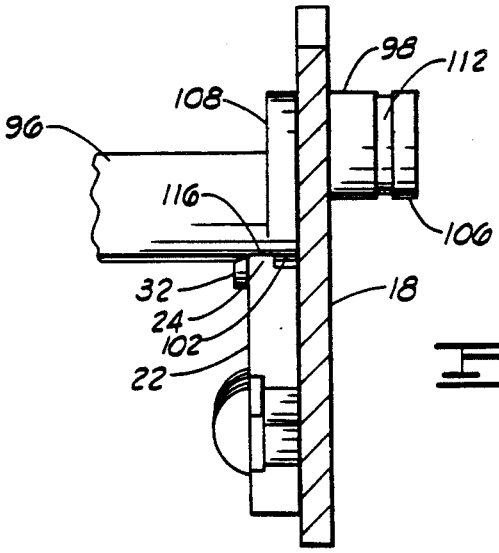
FIG. 7 is a cross-sectional view of the lock assembly taken along lines 7—7 of FIG. 6.
Figure 9:
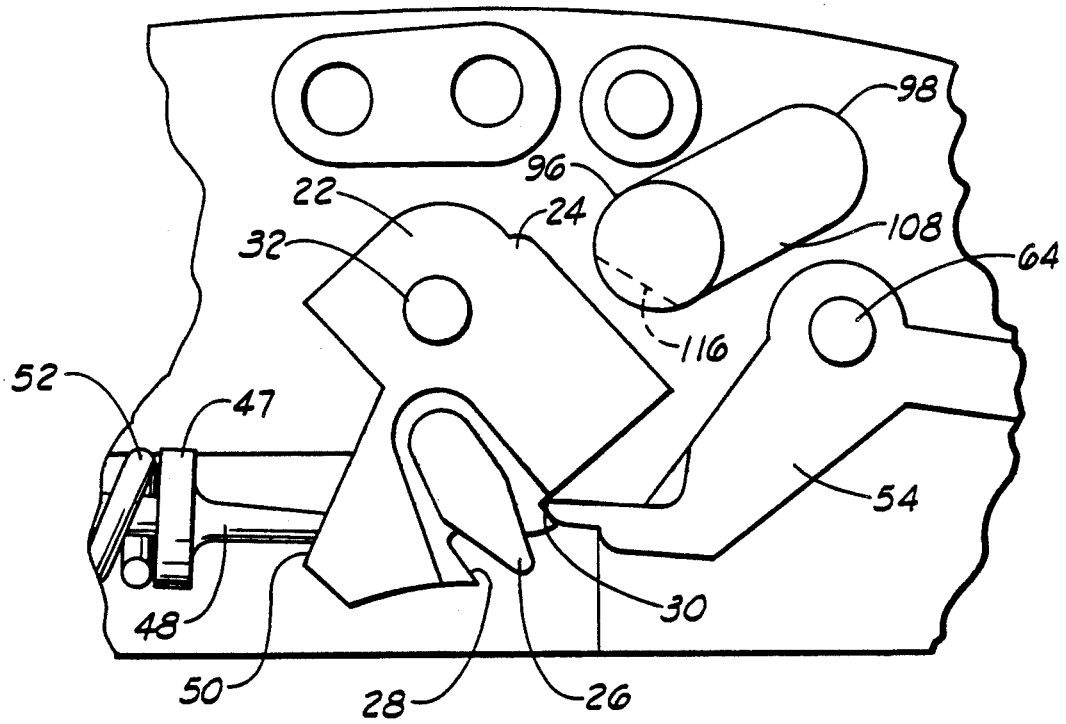
FIG. 9 is an enlarged fragmentary elevational view of the lock assembly shown in FIG. 8.

In operation, when the hammer 20 is in the fired position, the safety assembly is in the off position as shown in FIGS. 1, 3 and 4. When the hammer 20 is in the half cocked position, as shown in FIGS. 5–7, the safety assembly 10 may be positioned in the on position. In this way, the safety assembly 10 blocks the pivotal movement of the tumbler 22 and prevents the hammer 20 from returning to the fired position. When the hammer 20 is in the firing position, as shown in FIGS. 8 and 9, the safety assembly 10 may be retained in the on position such that the pivotal movement of the tumble 22 is blocked.

When the operator of the firing weapon desires to discharge the firing weapon by activating the trigger assembly in the conventional manner, the safety assembly 10 is positioned in the off position (FIG. 1). In this way, the safety assembly 10 permits the free movement of the tumbler 22, allowing the hammer 20 to fall from the firing position to the fired position.

Additionally, when the safety assembly 10 is in the on position and the hammer 20 is released from the firing position, the pivoting tumbler 22 contacts the safety assembly 10 such that the web 24 lodges in the groove 116 (FIG. 7). Before returning the safety assembly 10 to the off position, the force of the main spring 52 must be overcome by pivoting the hammer towards the firing position. In this way, the hammer 20 is prevented from continuing its fall to the fired position by casual or inadvertent repositioning of the safety assembly 10 to the off position.

Changes may be made in the construction, operation, and arrangement of the various parts, elements, and procedures described herein without departing from the spirit and scope of the invention as defined in the following claims.

What is claimed is:

1. A firing weapon comprising:

a hammer pivotally secured on the firing weapon for selective movement between a fired position and a firing position;

means for biasing the hammer towards the fired position;

means for selectively retaining the hammer in the firing position; and means for selectively preventing the hammer from pivoting from the firing position to the fired position when the hammer is released from the firing position, comprising:

a safety assembly slidably secured on the firing weapon for movement between an on position and an off position such that, when the safety assembly is in the on position, the hammer is prevented from pivoting from the firing position to the fired position and, when the safety assembly is in the off position, the hammer is permitted to pivot from the firing position to the fired position, comprising:

a first bar portion having a first and second end;

a first second bar portion having a first and second end; and means for securing the first bar portion to the second bar portion such that the center lines of the first and second bar portions are offset.

2. The apparatus of claim 1 wherein the means for securing the first bar portion to the second bar portion includes a web.

3. The apparatus of claim 2 wherein the web is positioned between the second end of the first bar portion and the first end of the second bar portion.

4. The apparatus of claim 1 wherein the safety assembly further includes means for retaining the safety assembly in a selected position.

5. The apparatus of claim 4 wherein the means for retaining includes portions of the first bar portion defining a detent.

6. The apparatus of claim 1 wherein the first bar portion has a circumferential annular groove adjacent the first end thereof.

7. The apparatus of claim 1 wherein the second bar portion has a circumferential annular groove adjacent the second end thereof.

8. A firing weapon comprising:

a shaft rotatably secured on the firing weapon having a first end and a second end;

a hammer secured on the first end of the shaft for selective movement between a fired position and a firing position;

a tumbler secured on the second end of the shaft such that the tumbler pivots within the firing weapon when the hammer is moved between the fired position and the firing position;

means secured between the firing weapon and the tumbler for biasing the hammer towards the fired position;

means engaging the tumbler for selectively retaining the hammer in the firing position; and means for selectively preventing the hammer from pivoting from the firing position to the fired position when the hammer is released from the firing position.

9. The apparatus of claim 8 wherein the means for selectively preventing the hammer from pivoting from the firing position to the fired position comprises a safety assembly slidably secured on the firing weapon for movement between an on position and an off position, such that when the safety assembly is in the on position and the hammer is released from the firing position, the movement of the tumbler is impeded by contacting the safety assembly, whereby the hammer is prevented from pivoting from the firing position to the fired position, and so that when the safety assembly is in the off position and the hammer is released from the firing position, the movement of the tumbler is unimpeded, whereby the hammer is permitted to pivot from the firing position to the fired position.

10. The apparatus of claim 9 further comprising:

means for preventing inadvertent movement of the safety assembly from the on position to the off position when the tumbler is in contact with the safety assembly.

11. The apparatus of claim 10 wherein the means for preventing inadvertent movement is characterized by a portion of the safety assembly having a groove therein and the tumbler having a web thereon, wherein the web is cooperatively sized for insertion into the groove when the tumbler is in contact with the safety assembly.

* * * * *

UNITED STATES PATENT AND TRADEMARK OFFICE
CERTIFICATE OF CORRECTION

PATENT NO. : 4,989,357

DATED : February 5, 1991

INVENTOR(S) : John W. Norman

It is certified that error appears in the above-identified patent and that said Letters Patent is hereby corrected as shown below:

On The Title Page, Item [76] Inventors:

The Co-Inventor's name "Rowell" should be --Powell--.

Column 1, line 17, the word "is" should be --in--.

Column 3, line 4, the word "assemble" should be --assembly--.

Column 3, line 17, the word "assemble" should be --assembly--.

Column 4, line 27, the word "tumble" should be --tumbler--.

Signed and Sealed this

Eighteenth Day of August, 1992

*Attest:*

DOUGLAS B. COMER

*Attesting Officer*

*Acting Commissioner of Patents and Trademarks*